US007253595B2

(12) United States Patent
Oddoart et al.

(10) Patent No.: US 7,253,595 B2
(45) Date of Patent: Aug. 7, 2007

(54) LOW DROP-OUT VOLTAGE REGULATOR

(75) Inventors: Ludovic Oddoart, Frouzins (FR); Gerald Miaille, Tempe, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 17 days.

(21) Appl. No.: 10/504,909

(22) PCT Filed: Feb. 12, 2003

(86) PCT No.: PCT/EP03/01367

§ 371 (c)(1),
(2), (4) Date: May 27, 2005

(87) PCT Pub. No.: WO03/069420

PCT Pub. Date: Aug. 21, 2003

(65) Prior Publication Data

US 2005/0225306 A1 Oct. 13, 2005

(30) Foreign Application Priority Data

Feb. 18, 2002 (EP) ..... 02290381

(51) Int. Cl.
*G05F 1/40* (2006.01)

(52) U.S. Cl. ..... 323/274; 323/275; 323/280; 323/284

(58) Field of Classification Search ..... 323/274, 323/275, 276, 284, 285, 316, 280
See application file for complete search history.

(56) References Cited

U.S. PATENT DOCUMENTS

| | | | | |
|---|---|---|---|---|
| 4,258,337 | A * | 3/1981 | Clinton | 331/110 |
| 5,578,951 | A * | 11/1996 | Lee et al. | 327/143 |
| 5,631,598 | A | 5/1997 | Miranda et al. | |
| 6,246,221 | B1 | 6/2001 | Xi | |
| 6,300,749 | B1 | 10/2001 | Castelli et al. | |
| 2002/0005711 | A1 | 1/2002 | Bakker et al. | |

FOREIGN PATENT DOCUMENTS

EP 0 957 421 B1 9/2003

OTHER PUBLICATIONS

PCT Search Report PCT/EP03/001367 mailed Aug. 19, 2003.

* cited by examiner

*Primary Examiner*—Jessica Han

(57) ABSTRACT

A low drop-out voltage regulator having a pass device (Mp), an error amplifier (M1-M51) and a double regulation loop including DC feedback loop (R1, R2) and an AC feedback loop (Rf, Cf) including a high pass filter (Cf). Combining these two loops creates an ultra low frequency internal pole which makes the regulator stable substantially independent of the output bypass capacitor's value. This provides the following advantages: allows the use of very low bypass capacitors; allows to extend the PSRR frequency behavior; allows an increase in the regulator's efficiency (reduced power consumption on heavy loads).

12 Claims, 6 Drawing Sheets

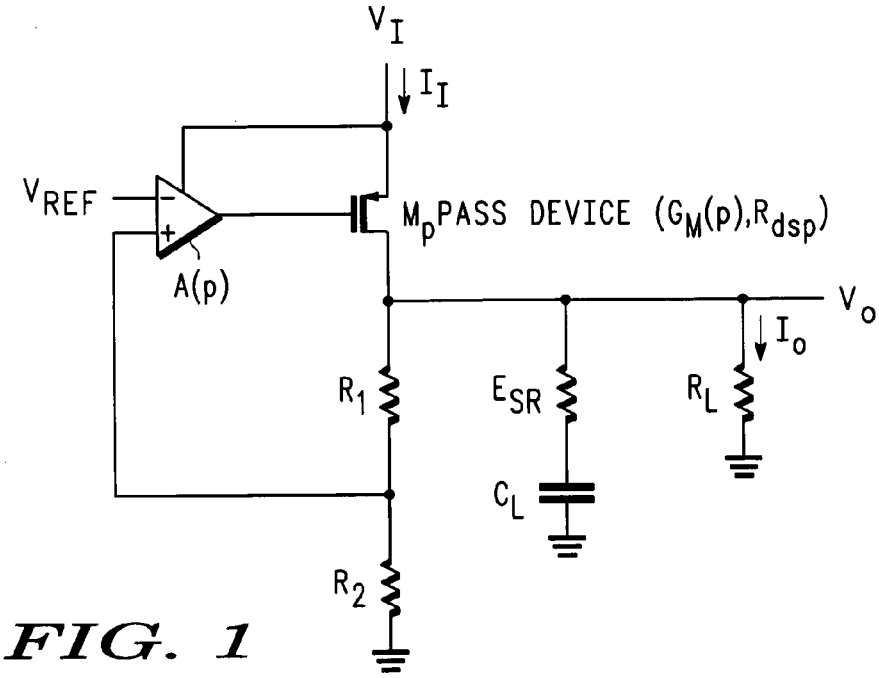
*FIG. 1*
-PRIOR ART-
*FIG. 2*
-PRIOR ART-
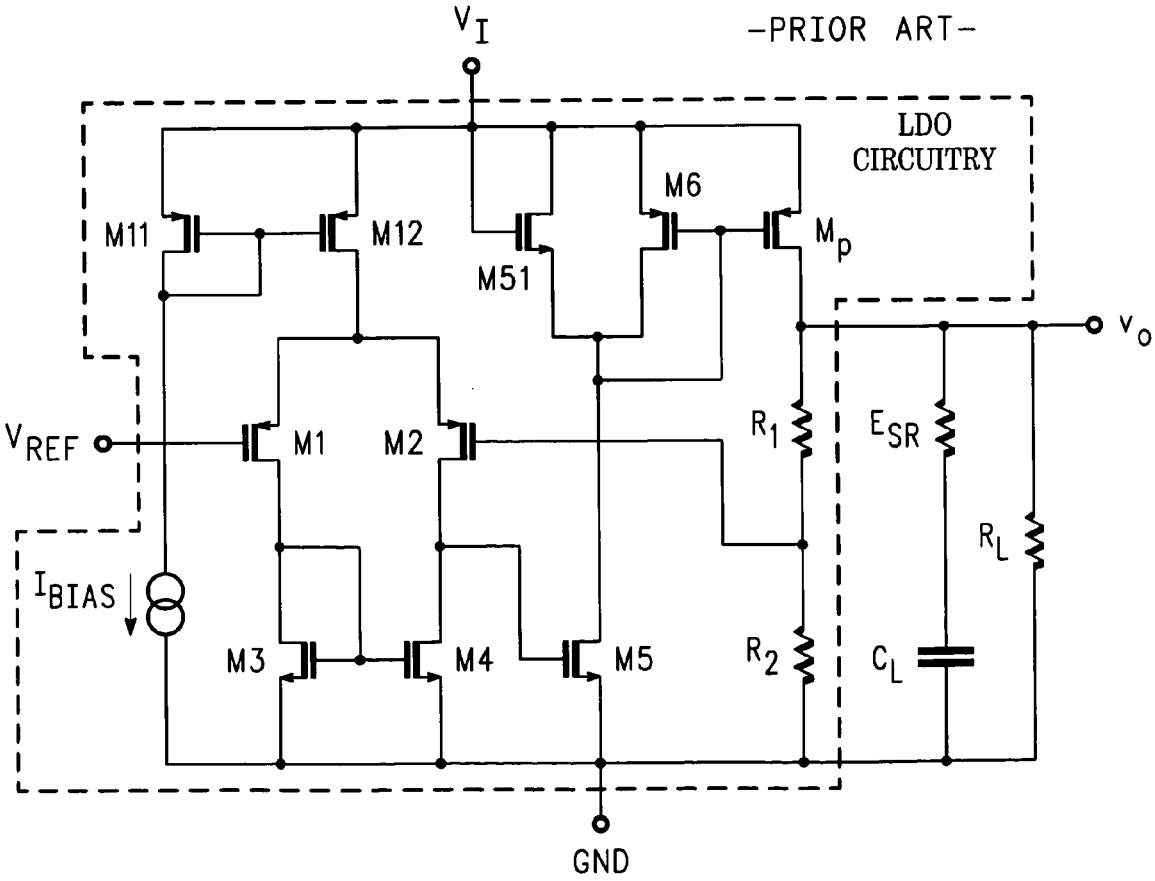

LOW DROP-OUT VOLTAGE REGULATOR

FIELD OF THE INVENTION

This invention relates to voltage regulators, and particularly to low drop-out (LDO) voltage regulators.

BACKGROUND OF THE INVENTION

A low drop-out voltage regulator is a regulator circuit that provides a well-specified and stable DC voltage (whose input-to-output voltage difference is typically low). The operation of the circuit is based on feeding back an amplified error signal which is used to control output current flow of a pass device (such as a power transistor) driving a load. The drop-out voltage is the value of the input/output differential voltage where regulation is lost.

The low drop-out nature of the regulator makes it appropriate (over other types of regulators such as dc-dc converters and switching regulators) for use in many applications such as automotive, portable, and industrial applications. In the automotive industry, the low drop-out voltage is necessary during cold-crank conditions where an automobile's battery voltage can be below 6V. Increasing demand for LDO voltage regulators is also apparent in mobile battery operated products (such as cellular phones, pagers, camera recorders and laptop computers), where the LDO voltage regulator typically needs to regulate under low voltage conditions with a reduced voltage drop.

A typical, known LDO voltage regulator uses a differential transistor pair, an intermediate-stage transistor, and a pass device coupled to a large (external) bypass capacitor. These elements constitute a DC regulation loop which provides voltage regulation.

Depending on the application, a critical component of the regulator is often its bypass capacitor. Indeed, to ensure stability under all operating conditions, large values of capacitor are used. This translates into large area on the PCB on which the regulator circuit is built, and higher costs.

However, this known LDO voltage regulator has the disadvantages that it is difficult (i) to significantly reduce the bypass-capacitor below approximately 1 μF per 10 mA output current capability, and (ii) to significantly increase the PSRR frequency behavior without high increase of power consumption.

A need therefore exists for a low drop-out voltage regulator wherein the abovementioned disadvantage(s) may be alleviated.

STATEMENT OF INVENTION

In accordance with the present invention there is provided low drop-out voltage regulator as claimed in claim 1.

At least in a preferred form, the present invention allows the use of capacitors lower than 1 μF overall, allowing costs to be significantly reduced, and ensures good stability (even if no external output capacitor is used—providing the most cost-efficient solution for applications where the transient response of the regulator is not a critical requirement). Also, since low capacitors have low serial resistance, the design of the LDO is made easier. In a preferred form the invention achieves such performance without increasing the overall power consumption of the LDO voltage regulator.

BRIEF DESCRIPTION OF THE DRAWINGS

One low drop-out regulator incorporating the present invention will now be described, by way of example only, with reference to the accompanying drawings, in which:

FIG. 1 shows a block-schematic circuit diagram of a typical, classical low drop-out voltage regulator;

FIG. 2 shows a block-schematic circuit diagram of a simplified practical implementation of the LDO voltage regulator of FIG. 1;

DESCRIPTION OF PREFERRED EMBODIMENT(S)

A classic, known low drop-out regulator is depicted in FIG. 1. It is partitioned into 3 main parts: Pass-device (MOS transistor $M_p$—having transconductance $G_M(P)$ and resistance $R_{dsp}$), error amplifier (A(p)) and resistor feedback ($R_1$, $R_2$). The pass-device $M_p$ is used as a current-source, which is driven by the error amplifier (A(p)) to pass a current $I_I$ from an input voltage $V_I$. The output voltage $V_O$ is divided by the resistor ladder $R_1$, $R_2$ and compared with reference voltage $V_{REF}$. The current in the pass-device $M_p$ is controlled according to this difference. Bypass capacitor $C_L$ (having electrical series resistance $E_{SR}$) is connected to the the output, and output resistance of the load is represented by $R_L^-$. The output voltage is given by:

$$V_O = V_{REF}\left(1 + \frac{R_1}{R_2}\right) \tag{1}$$

To obtain a low drop-out voltage, a PMOS pass device is the most convenient transistor for power management applications.

Most low-dropout regulators designs use the regulation architecture combined with pole-tracking. Even if topologies are changing to improve a given specification requirement, pole tracking is a common and an efficient design technique. Indeed, to prevent instability due to changes of the output current, a local feedback is used to perform a tracking between the output pole and the pole of the intermediate stage. FIG. 2 shows a simplified schematic of a practical implementation of the LDO voltage regulator of FIG. 1, typically used for wireless applications. In the circuit of FIG. 2, the differential pairs of MOS transistors $M_1$-$M_4$ constitute the first stage of the amplifier and drive an intermediate stage $M_5$, $M_6$, $M_{51}$. The amplifier has an input stage constituted by MOS transistors $M_{11}$ and $M_{12}$ producing a current $I_T$, and is biased by a current source producing a bias current $I_{BIAS}$.

Pole-tracking is implemented using the current mirror between $M_P$ and $M_6$. By feeding a part of the current of the pass-device in the intermediate stage, the impedance and the pole of this stage tracks the output impedance/pole. However, although it is easier to stabilize the regulator of FIG. 2 under variations in load current $I_{LOAD}$ using the pole tracking scheme, the inventors of the present invention have recognized that the problem of stability regarding variations of $E_{SR}$ is still unsolved since there is no means to sense the value of this serial resistance.

The absolute stability of a regulator is an implicit specification, which is the root cause of many trade-offs in designing the regulator. Before considering the stability of the regulator in more detail, its open-loop frequency response must be calculated.

Figure 3:
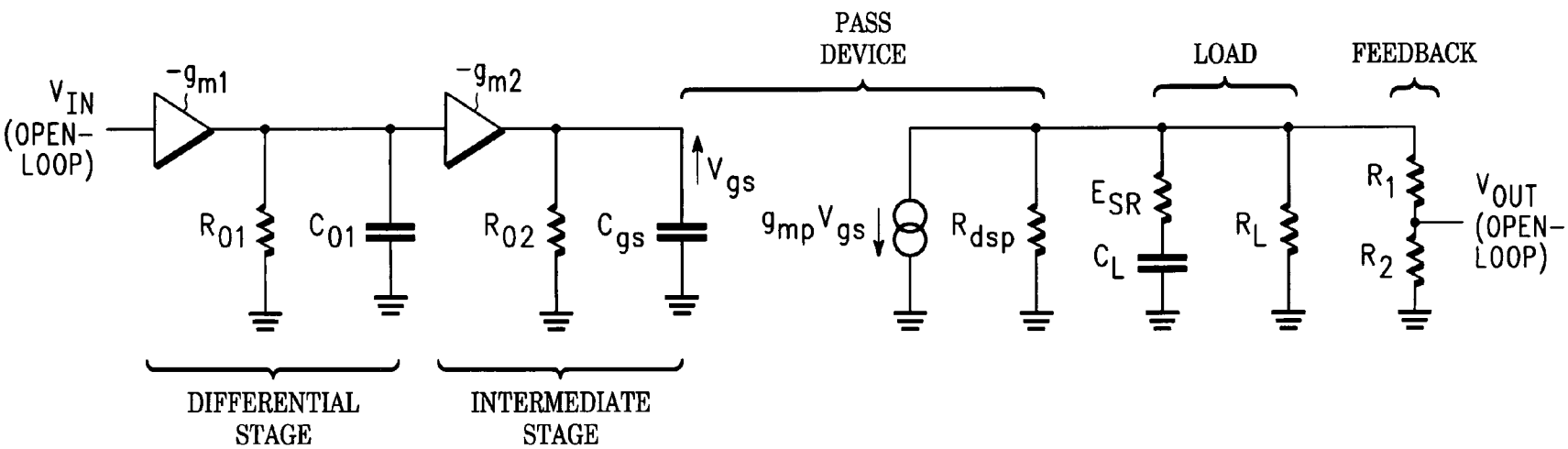
FIG. 3 shows a block-schematic circuit diagram illustrating the open-loop AC-model of the LDO voltage regulator of FIG. 2.

FIG. 3 shows the AC model of the low drop-out regulator of FIG. 2. In the model of FIG. 3, the low drop-out regulator of FIG. 2 is modeled as follows:

- the differential stage (transistors $M_1$-$M_4$) is modeled by an amplifier of gain $-g_{m1}$, a resistor $R_{o1}$ and a capacitor $C_{o1}$;
- the intermediate stage (transistors $M_5$, $M_6$, $M_{51}$) is modeled by an amplifier of gain $-g_{m2}$, a resistor $R_{o2}$ and a capacitor $C_{gs}$;
- the pass device $M_p$ is modeled by the capacitor $C_{gs}$, a voltage controlled current source driven by a voltage $V_{gs}$ and a resistor $R_{dsp}$;
- the load section is modeled by the resistor $E_{SR}$ and capacitor $C_L$ and the resistor $R_L$; and
- the feedback loop is modeled by the resistors $R_1$ and $R_2$.

The open-loop gain of this model is:

$$OpenLoopGain(s) = \frac{N_{OLG}(s)}{D_{OLG}(s)} \tag{2}$$

where $$N_{OLG}(s) = -R_2 g_{m1} r_{o1} g_{m2} r_{o2} g_{mp} R_S (1 + E_{SR} C_L s)$$

$$D_{OLG}(s) = (R_1 + R_2)(1 + R_{o1} C_{o1} s)(1 + R_{o2} C_{gs} s)(1 + (E_{SR} + R_s) C_L s) \text{ and}$$

$R_S = (R_1 + R_2) // R_L // R_{dsp}$, '//' indicating 'in parallel'.

The open-loop DC gain of the model is:

$$A_{OL}(\mathrm{DC}) = \frac{R_2}{R_1 + R_2} g_{m1} r_{o1} g_{m2} r_{o2} g_{mp} R_s \tag{3}$$

The system has 3 poles and 1 zero. The main pole is the pole of the output stage:

$$F_{OUT} = \frac{1}{2\pi (E_{SR} + R_S) C_L}$$

$E_{SR}$ is low compared to $R_S$ and can be neglected. It can be seen that this pole is a function of the load, which means that it changes with the load current. The relation is direct proportional and the pole-frequency increases directly with the output current. It should be noted that the low-frequency gain of the output stage is given by the equation:

$$A_{outputstage}(\mathrm{DC}) = g_{mp} R_S \propto g_{mp} R_S$$

It is also a function of the output current, but the relation is different to that of the pole. $G_m$ changes with the square root of the load current. $R_L$, which represents the load current, varies directly with the current. This means that the gain decreases with the square root of the load current. Finally, when the output current increases, the output pole increases faster than the open-loop gain decreases. Depending on the design and the operating conditions, the pole of the differential stage is placed before or after that of the intermediate stage:

$$F_{pdiff} = \frac{1}{2\pi R_{o1} C_{o1}}$$

$$F_{pint} = \frac{1}{2\pi R_{o2} C_{gs}}$$

The zero is created by the $E_{SR}$ of the output capacitor:

$$Z_{ESR} = \frac{1}{2\pi E_{SR} C_L}$$

It is obvious that such a system can be unstable under certain conditions. To simplify the study of the stability, the problem is split into 2 cases:

$E_{SR}$ is constant and the output current varies, and the output current is constant and $E_{SR}$ varies.

Figure 4:
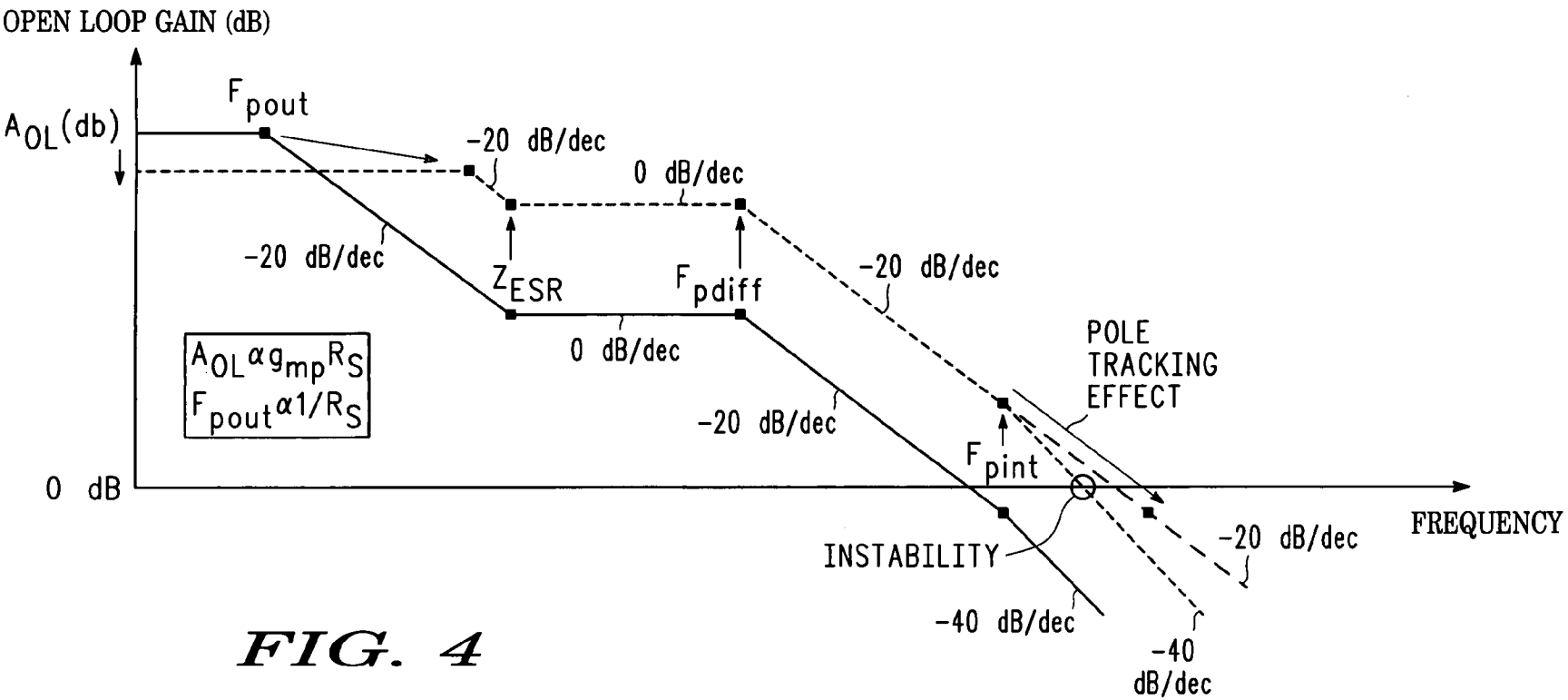
FIG. 4 shows a graphical illustration of the stability of the LDO voltage regulator of FIG. 2 under conditions of varying load.

$F_{pout}$ is the main pole and varies with the output current. If $I_{LOAD}$ is minimum $F_{pout}$ is placed at low-frequencies. At the opposite extreme, when $I_{LOAD}$ is maximum, $F_{pout}$ is a high-frequency pole. FIG. 4 depicts the problem of stability, when the output current goes from its minimum to its maximum value (minimum value of the current in the pass-device is set by the feedback resistor). These curves show that if the system is stable under low-load conditions, it is not stable when the regulator operates under heavy-load conditions. Indeed, when changing from low to heavy load, the open-loop DC gain $A_{OL}$ decreases proportionally with the square-root of the current in the pass-device, but the output pole is pushed toward high-frequencies proportionally to this current. This is why the frequency response crosses the 0 dB-axis with a slope of −40 dB/decade leading to the instability of the system. This analysis explains the use of the pole-tracking scheme implemented in most of regulators.

The effect of the pole tracking is depicted in FIG. 4. By pushing $F_{pint}$ toward high-frequencies proportionally to the output current, the 0 dB-axis is now crossed with a slope of −20 dB/decade.

It may be noted that since the zero due to $E_{SR}$ and the poles of the differential pair and the intermediate stage are constant, the gain between the frequencies $Z_{ESR}$ and $F_{pdiff}$ is higher under heavy-load conditions than for low-load conditions, explaining why the stability is more critical under heavy-load operations.

Figure 5:
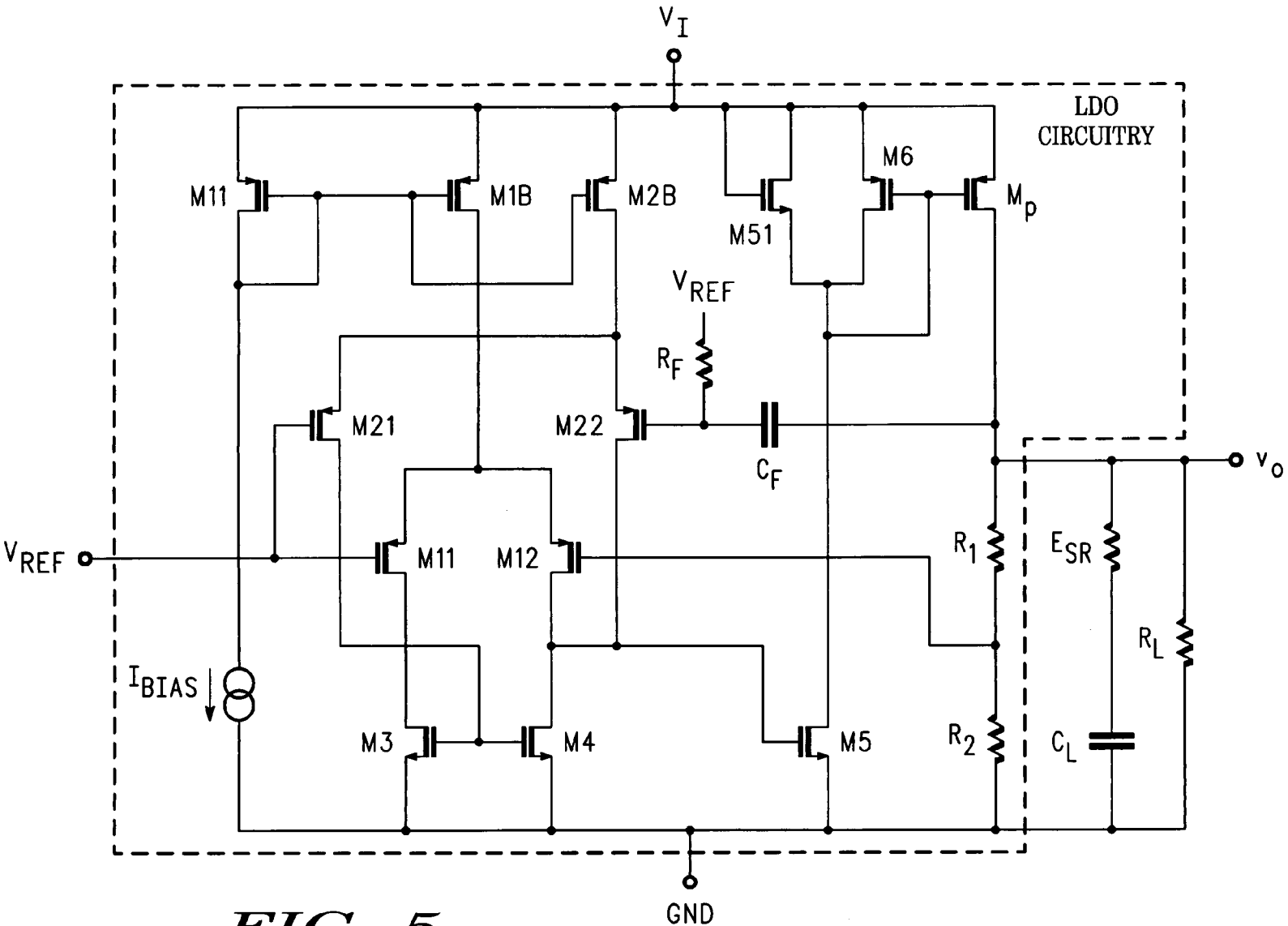
FIG. 5 shows a block-schematic circuit diagram of an LDO voltage regulator incorporating the present invention.

Referring now to FIG. 5, a new, improved LDO voltage regulator adds an extra feedback loop to the classical architecture (e.g., FIG. 2). Compared with the prior art LDO of FIG. 2, the LDO of FIG. 5 includes additional MOS transistors $M_{2B}$, $M_{21}$ and $M_{22}$, together with capacitor $C_F$ (and resistor $R_F$ through which reference voltage $V_{REF}$ is applied). The LDO regulator circuit as shown in FIG. 5 is typically fabricated substantially entirely (the portion within the dashed line) in integrated circuit form, only the bypass capacitor and load (represented by the components $E_{SR}$, $C_L$ and $R_L$) being external to the integrated circuit.

The LDO of FIG. 5 thus includes a feedback loop (as in the prior art LDO of FIG. 2) formed by $R_1$, $R_2$ and the differential pair $M_{11}$, $M_{12}$. Additionally, the LDO of FIG. 5 includes an extra feedback loop containing $R_F$, $C_F$ and the second differential pair $M_{21}$, $M_{22}$. Due to the high-pass filter formed by $R_F$ and $C_F$ this additional feedback does not act at DC but in middle-frequencies; it helps to regulate the output voltage and to stabilize the system. A large value for $R_F$ is implemented by using an integrated resistor or a depletion transistor with a large length.

As will be discussed in more detail below, Combining these two feedback loops creates an ultra low frequency internal pole which makes the regulator stable, substantially independent of the value (or, with particular applicability to applications where the transient response of the regulator is not a critical requirement, even the absence) of the output bypass capacitor. Also, since low capacitors have low serial resistance, the design of the LDO is made easier. Further, it will be understood that, thanks to the high pass filter provided by $C_F$, the extra feedback loop increases the PSRR for high frequencies.

The system of FIG. 5 has two loops which have to be opened and analyzed separately. Using a simplified AC-model such as depicted in FIG. 6, the poles and zeroes of the main loop can be found.

Figure 6:
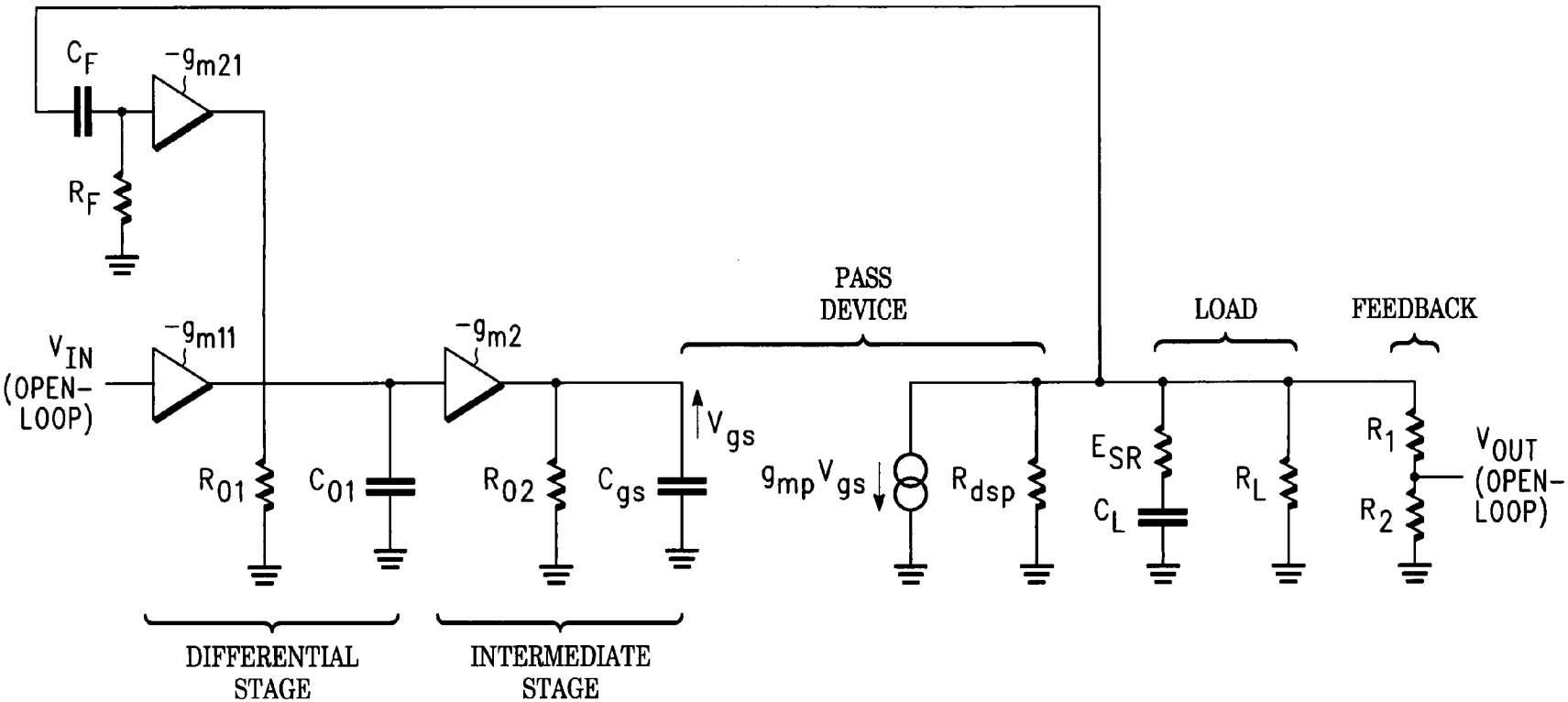
FIG. 6 shows a block-schematic circuit diagram illustrating the open-loop AC model of the LDO voltage regulator of FIG. 5.

As shown in FIG. 6, the LDO of FIG. 5 is modeled as follows:

- the differential stages of transistors $M_1$-$M_4$, $M_{21}$ & $M_{22}$ and $M_{11}$ & $M_{12}$ are modeled by amplifiers of gain $-g_{m21}$ & $-g_{m11}$, a resistor $R_{o1}$ and a capacitor $C_{o1}$;
- the intermediate stage (transistors $M_5$, $M_6$, $M_{51}$) is modeled by an amplifier of gain $-g_{m2}$, a resistor $R_{o2}$ and a capacitor $C_{gs}$;
- the pass device $M_p$ is modeled by the capacitor $C_{gs}$, a voltage controlled current source driven by a voltage $V_{gs}$ and a resistor $R_{dsp}$;
- the load section is modeled by the resistor $E_{SR}$ and capacitor $C_L$ and the resistor $R_L$;
- the main feedback loop is modeled by the resistors $R_1$ and $R_2$; and
- the AC feedback loop is modeled by $R_F$ and $C_F$.

The open-loop gain at DC for the main loop is:

$$A_{OL_{MAIN\text{-}LOOP}}(\mathrm{DC}) = \frac{R_2}{R_1 + R_2} g_{m11} r_{o1} g_{m2} r_{o2} g_{mp} R_s \tag{4}$$

Equation (4) clearly shows that the DC performance-of the LDO of FIG. 5 is not impacted by the extra feedback loop.

The main loop has now 2 zeroes instead of 1 in the classical configuration of FIG. 2, and 4 poles instead of 3. With this new structure, the first pole is now:

$$P_1 = \frac{1}{2\pi A_2 R_F C_F} \text{ with } A_2 = g_{m21} r_{o1} g_{m2} r_{o2} g_{mp} R_s$$

The low-frequency zero is created by the high-pass filter:

$$Z_2 = \frac{1}{2\pi R_F C_F}$$

It is followed by two (real or complex) poles $P_2$, $P_3$ related to the second order term:

$$1 - Z_4 s + \frac{Z_4^2 T_2}{T_2 - Z_4} s^2$$

The previous location of poles and zeroes clearly shows that the extra feedback loop creates a very low frequency pole which is internal while reducing the effect of the output stage on the regulator's stability. If $A_2$ is large enough, the pole-tracking scheme is no longer required. Finally, the power consumption at full load is improved.

Figure 7:
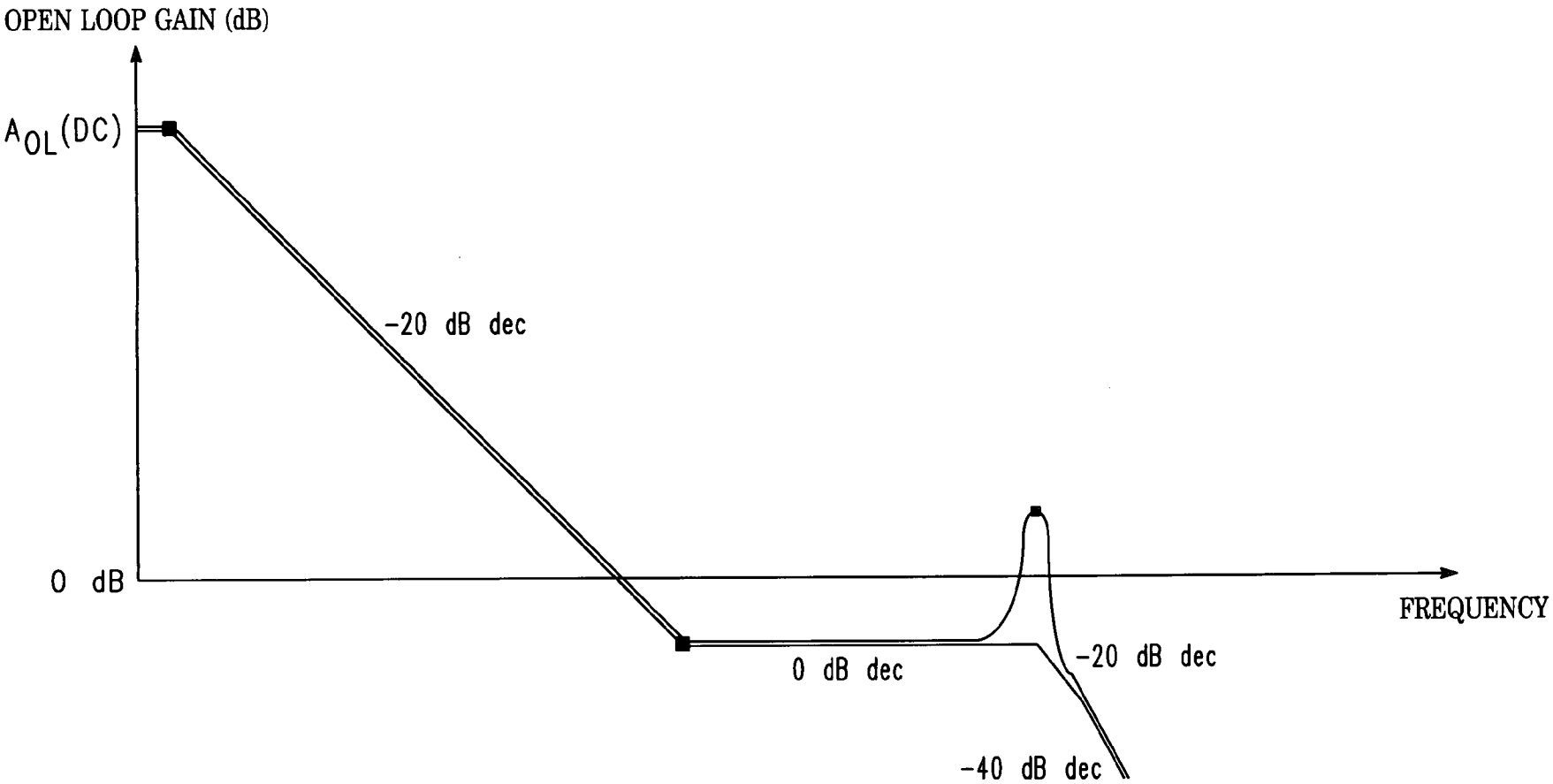
FIG. 7 shows a graphical illustration, similar to FIG. 4, of the open-loop performance of the LDO voltage regulator of FIG. 5.

This very low-frequency pole related to the new LDO of FIG. 5 implies a very good phase margin of the system with high output currents and very low output capacitors. The locations of the new poles and zeroes are depicted FIG. 7, which shows the open-loop gain of the DC-feedback loop without (lower line) and with (upper line) a frequency-peak.

The stability of the extra feedback loop may be analysed from the following expression for the open-loop gain of the extra feedback loop:

$$A_{OL_{2nd-LOOP}}(s) = \frac{A_{OL_{MAIN-LOOP}}(\mathrm{DC}) \cdot (R_F C_F s) \cdot (1 + E_{SR} C_L s)}{(1 + R_F C_F s) \cdot \left(1 + \left(E_{SR} + \frac{R_F}{A_1} C_L s\right) R_F C_F s\right) \cdot \left(1 + \left(\frac{R_S \cdot R_{02}}{A_1 E_{SR} + R_S}\right) C_{gs} s\right) \cdot (1 + R_{01} C_{01})}$$

where $A_{OL_{2nd-LOOP}}(\mathrm{DC}) = g_{m21} r_{01} g_{m2} r_{02} g_{mp} R_s$ and $A_1 = \frac{R_2}{R_1 + R_2} g_{m11} r_{01} g_{m2} r_{02} g_{mp} R_s$ The locations of the poles and zeroes and the stability analysis can be deduced from the above equation for $A_{OL_{2nd\text{-}LOOP}}(s)$.

It will be appreciated that, due to the capacitor $C_F$, the extra feedback loop provides only AC feedback. As previously explained, this loop acts at middle frequencies. Since the feedback voltage is directly taken at the output of the regulator, this new arrangement provides an increase in the bandwidth of the PSRR.

It will be understood that the improved low drop-out regulator described above provides the following advantages:

- Allows the use of very low bypass capacitors (which, with particular applicability to applications where the transient response of the regulator is not a critical requirement, may even be absent). Also, since low capacitors have low serial resistance, the design of the LDO is made easier.
- Allows extended bandwidth of PSRR frequency behavior.
- Allows increased regulator efficiency (reduced power consumption with heavy loads).

The invention claimed is:

1. A low drop-out voltage regulator comprising:

pass means for controlledly passing a current from an input voltage applied thereto to produce a controlled output voltage;

feedback means, including a DC first feedback loop coupled to the regulator output, for providing a feedback signal representative of the output voltage there at; and error amplifier means for comparing the feedback signal with a predetermined voltage and for producing a signal in dependence on the comparison for controlling the pass means;

the feedback means also includes an AC second feedback loop coupled to the regulator output, and arranged in parallel with the DC first feedback loop, for operating in combination with the DC first feedback loop.

2. The low drop-out voltage regulator of claim 1 wherein the AC feedback loop includes a high pass filter.

3. The low drop-out voltage regulator of claim 1 wherein the feedback voltage of the AC feedback loop is taken directly at the regulator's output.

4. The low drop-out voltage regulator of claim 1 wherein the AC feedback loop includes a large value resistor formed by an integrated resistor.

5. The low drop-out voltage regulator of claim 1 wherein the AC feedback loop includes a large value resistor formed by a depletion transistor with a large length.

6. An integrated circuit comprising a low drop-out voltage regulator of claim 1.

7. A low drop-out voltage regulator comprising:

pass circuit for controlledly passing a current from an input applied thereto to produce a controlled output voltage;

feedback circuit, including a DC first feedback loop coupled to the regulator output, for providing a feedback signal representative of the output voltage thereat; and error amplifier circuit for comparing the feedback signal with a predetermined voltage and for producing a signal in dependence on the comparison for controlling the pass circuit;

wherein the feedback circuit also includes an AC second feedback loop coupled to the regulator output, and arranged in parallel with the DC first feedback loop, for operating in combination with the DC first feedback loop.

8. The low drop-out voltage regulator of claim 7 wherein the AC feedback loop includes a high pass filter.

9. The low drop-out voltage regulator of claim 7 wherein the AC feedback voltage of the AC feedback loop is taken directly at the regulator's output.

10. The low drop-out voltage regulator of claim 7 wherein the AC feedback loop includes a large value resistor formed by an integrated resistor.

11. The low drop-out voltage regulator of claim 7 wherein the AC feedback loop includes a large value resistor formed by a depleting transistor with a large length.

12. An integrated circuit comprising a low drop-out voltage regulator of claim 7.

* * * * *